United States Patent [19]

Kishikawa et al.

[11] 4,334,419

[45] Jun. 15, 1982

[54] METHOD FOR ROLLING STEEL SECTIONS HAVING FLANGES OR FLANGE-LIKE PORTIONS

[75] Inventors: Kanichi Kishikawa; Kazuo Watanabe; Hideki Tokita; Taneharu Nishino, all of Kitakyusyushi; Seiichi Nagasoe, Munakatamachi, all of Japan

[73] Assignee: Nippon Steel Corporation, Tokyo, Japan

[21] Appl. No.: 23,236

[22] Filed: Mar. 23, 1979

[30] Foreign Application Priority Data

Mar. 29, 1978 [JP] Japan ..... 53/35566

[51] Int. Cl.[3] ..... B21B 1/08

[52] U.S. Cl. ..... 72/225; 72/234; 72/366

[58] Field of Search ..... 72/234, 181, 177, 225, 72/226, 366, 229

[56] References Cited

U.S. PATENT DOCUMENTS

| | | | |
|---|---|---|---|
| 939,168 | 11/1909 | Sack | 72/225 X |
| 1,812,247 | 6/1931 | Oberg et al. | 72/225 |
| 4,086,801 | 5/1978 | Nakajima et al. | 72/234 |

FOREIGN PATENT DOCUMENTS

| | | | |
|---|---|---|---|
| 46-17577 | 5/1971 | Japan | 72/225 |
| 52-16463 | 10/1977 | Japan | 72/234 |

*Primary Examiner*—Lowell A. Larson

*Attorney, Agent, or Firm*—Wenderoth, Lind & Ponack

[57] ABSTRACT

A method for rolling a steel section having flanges or flange-like portions from a steel bloom of rectangular cross section in a rolling mill having a train of roughing rolling stands for roughing, a universal rolling stand with a pair of opposing horizontal rolls and a pair of opposing vertical rolls, and a train of finishing rolling stands for finishing. The method includes rolling the bloom in the train of roughing rolling stands for roughing to a rough shape having a width greater than the shortest distance between the outer circumferences of the opposed vertical rolls in the universal rolling stand and having a reduced almost flat cross section including a portion to be shaped into flanges or flange-like portions in the final product, rolling the rough shape of flat cross section thus obtained in the universal rolling stand for causing the pair of vertical rolls and the pair of horizontal rolls to cooperatively give bending deformation mainly to the portions to be shaped into the flanges or flange-like portions, and finish rolling the rough shape produced from the bending deformation in the finishing rolling stands for finishing.

5 Claims, 19 Drawing Figures

(a)

(b)

Fig. 4
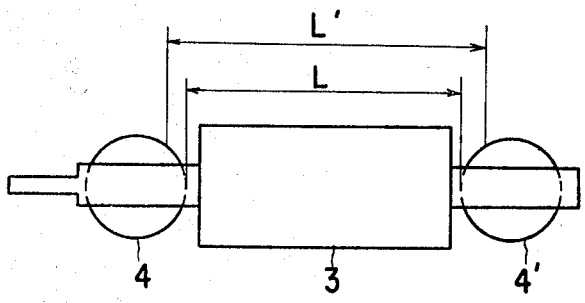
FIG. 5 (a)
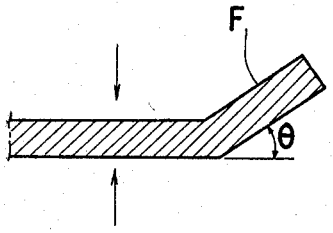
FIG. 5 (b)
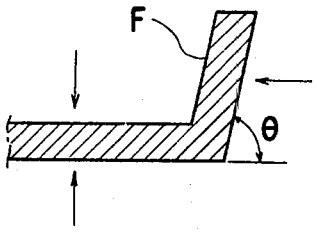
Fig. 6 (b)
FIG. 6 (a)
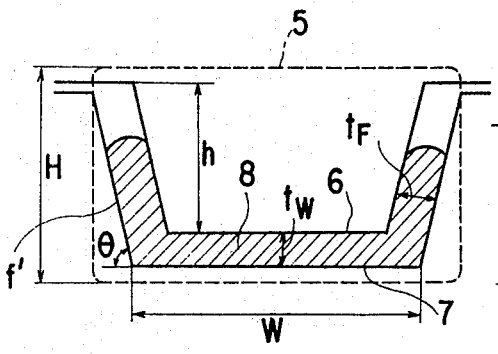
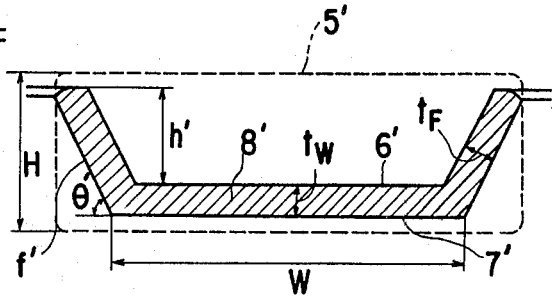

(A)

(B)

METHOD FOR ROLLING STEEL SECTIONS HAVING FLANGES OR FLANGE-LIKE PORTIONS

BACKGROUND OF THE INVENTION

The present invention relates to a method for rolling steel sections, such as steel piles having flanges or flange-like portions using a train of shaping rolling stands and a universal rolling stand.

In the past, such steel sections were usually produced by a shaping rolling method using rolling stands each fitted with upper and lower horizontal rolls, hereinafter generally called shaping rolling stands. They include breakdown stands, roughing stands, intermediate rolling stands and finishing rolling stands. More recently, however, as disclosed in Japanese Patent Publication No. 47-47784, there is a trend particularly in the rolling of H sections to employ a universal rolling stand fitted with a pair of horizontal rolls and a pair of vertical rolls in conjunction with the shaping rolling stands. This rolling method is herein called "the universal rolling method".

The general differences between the shaping rolling method and the universal rolling method are illustrated schematically in FIG. 1 in connection with the rolling of steel sheet piles. The difference between the shaping rolling method shown in FIG. 1(*a*) and the universal rolling method shown in FIG. 1(*b*) lies in the manner in which the intermediate rolling passes (K-6, K-5 and K-4 in FIG. 1(*a*)) are changed. In the shaping rolling method these are shaping rolling passes whereas in the universal rolling method they are universal rolling passes. All other rolling passes of the universal rolling method are the same as those in the shaping rolling method. Adoption of the universal rolling method makes it possible to start with a steel bloom 2 of rectangular cross section as shown in FIG. 1(*b*) instead of the conventionally required roughly shaped beam blank 1 shown in FIG. 1(*a*) and results in simplification of the breakdown rolling process, reduction of roll unit cost and easier adjustment of the contour and dimensions in the rolling of steel sections. These advantages contribute to the development of more economical rolling methods for producing steel sections having very precise contour and dimensions.

The universal rolling method is, however, not completely free from defects and, in particular, involves the following two problems:

(1) Because a bloom of rectangular cross section is used in place of the conventionally used beam blank, the starting material used in the universal rolling method has a greater cross sectional area than that used in the conventional method. Therefore, when the nature of the facilities makes it necessary to maintain a fixed magnitude of product elongation, it becomes necessary to use starting materials having a shorter length. This, in some cases, results in lowering of the rolling yield, the heating furnace productivity, etc. Therefore, in order to eliminate this disadvantage, it is necessary to provide a rolling method which can use a starting material of rectangular cross section which is as long and thin as possible.

(2) It is generally more difficult to obtain a steel section of the desired final contour when a starting material with a rectangular cross section is used than it is when a roughly shaped beam blank is used and a considerable number of shaping rolling passes are nevertheless required before the universal rolling pass.

SUMMARY OF THE INVENTION

One object of the present invention is to provide a universal rolling method for steel sections which completely overcomes the above problems and, moreover, permits simplification of rolling mill layout, reduction of roll unit cost and the number of rolling passes, and improvement of rolling efficiency.

The present invention provides a method for rolling a steel section having flanges or flange-like portions from a steel bloom of rectangular cross section in a rolling mill comprising a train of roughing shaping rolling stands for roughing, a universal rolling stand comprising a pair of opposed horizontal rolls and a pair of opposed vertical rolls, and a train of finishing shaping rolling stands for finishing, which method comprises rolling the bloom in the train of roughing shaping rolling stands for roughing to a rough shape having a width greater than the shortest distance between the outer circumferences of the opposed vertical rolls in the universal rolling stand and having a reduced almost flat cross section including a portion to be shaped into flanges or flange-like portions in the final product, rolling the rough shape of flat cross section thus obtained in the universal rolling stand thereby causing the pair of vertical rolls and the pair of horizontal rolls to cooperatively subject the portions to be shaped into the flanges or flange-like portions to bending deformation, and finish rolling the rough shape produced for the bending deformation in finishing shaping rolling stands.

Other objects of the present invention will be understood from the following descriptions.

BRIEF DESCRIPTION OF THE DRAWINGS:

FIG. 4 is a schematic plan view showing the roll arrangement in a universal rolling stand;

FIGS. 5(*a*) and 5(*b*) are schematic sectional views showing the relation between the direction of rolling reduction and the direction of the bending of the flange portions, FIG. 5(*a*) being for the shaping rolling method and FIG. 5(*b*) being for the universal rolling method;

FIGS. 6(*a*) and 6(*b*) are schematic sectional views showing the difference in shaping of the material caused by the difference in the flatness of the shaping rolls;

Figure 7:
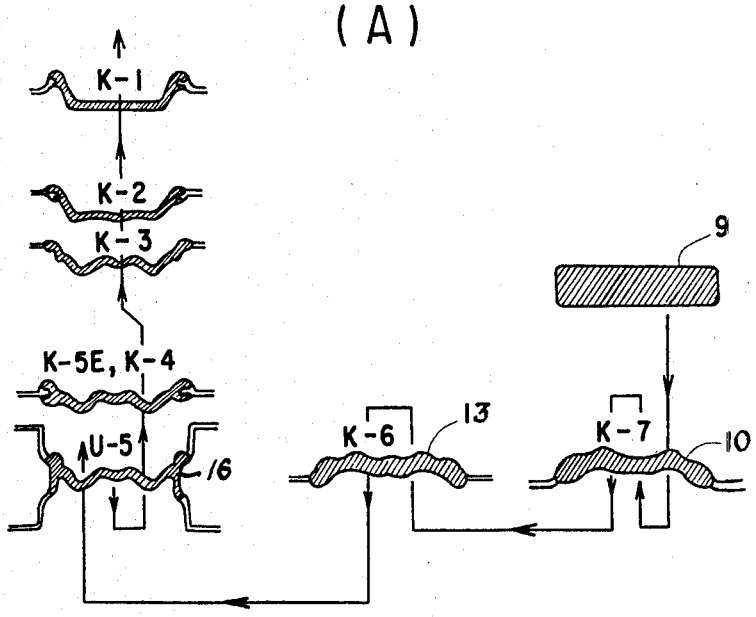
FIG. 7(A) is a flow sheet for one example of the method according to the present invention for production of steel sheet piles having a contour corresponding to the shape rolled by the shaping roll pass K-1.
Figure 7:
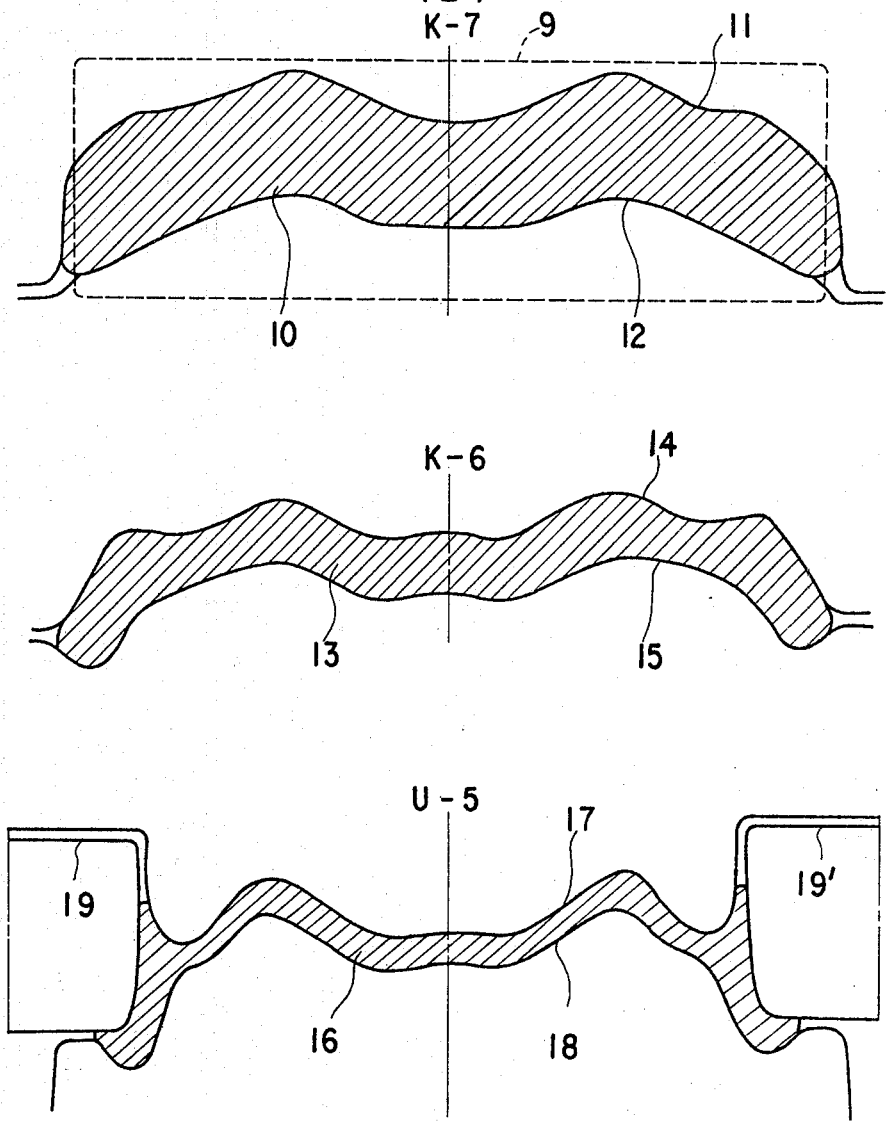
Figure 8:
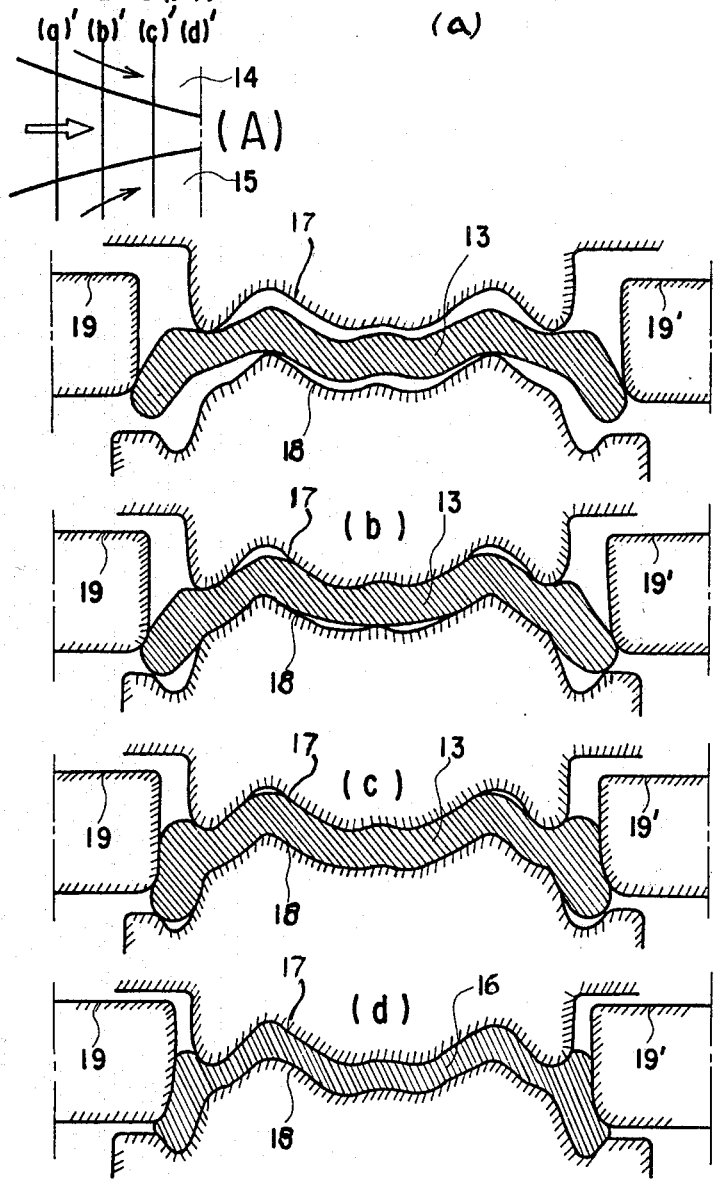
Figure 9:
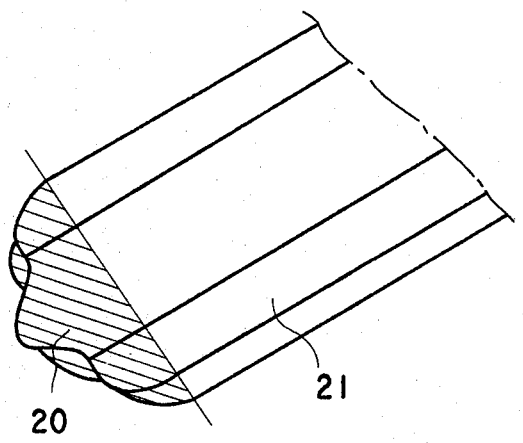

The parts of FIG. 7(B) are enlarged schematic sectional views showing the shapes of the material in shaping roll passes K-7, and K-6 and universal rolling pass U-5 in the method shown in FIG. 7(A);

FIGS. 8(*a*)–(*d*) are schematic vertical cross-sectional views at successive positions (a)′–(d)′ in FIG. 8(A) on the inlet side of the universal roll pass U-5 shown in FIG. 7(A); and FIG. 9 is a perspective view of the material prior to entering the universal rolling pass U-5 of FIG. (A).

DETAILED DESCRIPTION OF THE INVENTION

Shaping rolling of ordinary steel sections has a long history and many shaping roll designs have been proposed and adopted in practice. Standard shaping roll designs can be found in large numbers in technical literature and reports.

Figure 1:
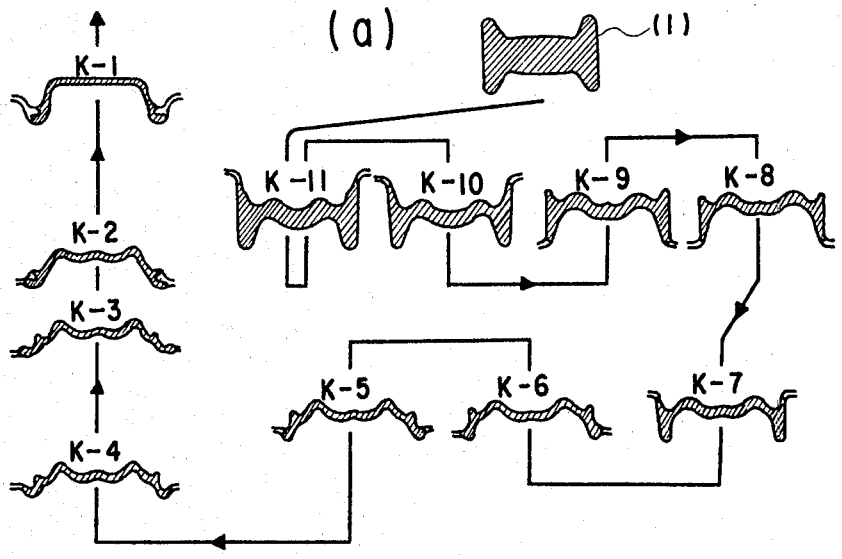
Fig. 1 (PRIOR ART)
FIGS. 1(*a*) and 1(*b*) are schematic views showing conventional rolling methods for rolling steel sections, FIG. 1(*a*) showing the shaping rolling method and FIG. 1(*b*) showing the universal rolling method.
Figure 1:
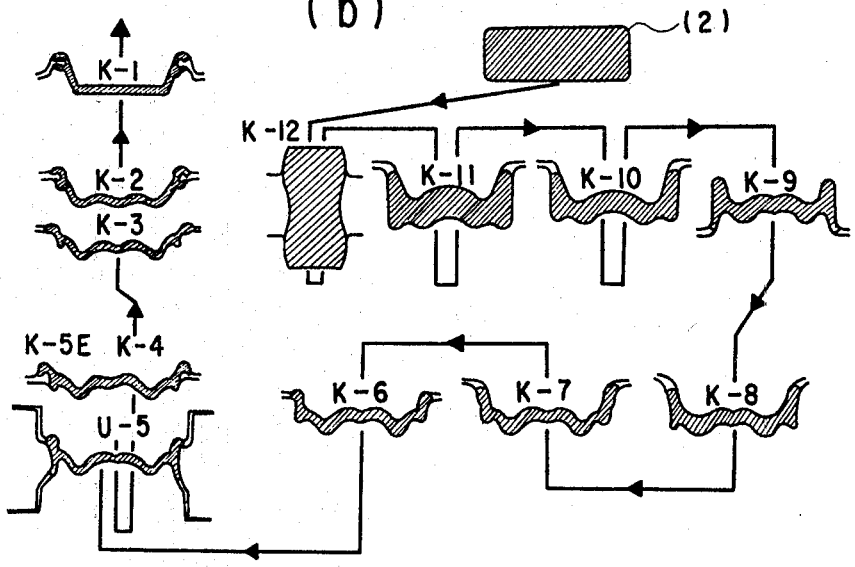
FIG. 1 (PRIOR ART)

In the conventional methods as shown in FIGS. 1(*a*) and 1(*b*), the letter K designating a numbered pass represents a pass for shaping rolling by two horizontal rolls, and U designating a numbered pass represents universal rolling by two horizontal rolls and two vertical rolls. The numbers indicate the order of the passes with the final caliber roll pass being designated 1. The arrow indicates the sequence of the rolling steps and where two or more arrows traverse a pass, this indicates that reverse rolling is carried out to produce two or more passes through the shaping roll pass.

One principle governing the design of shaping roll passes is that the width of the material entering the shaping rolling stand must generally be less than the width of the shaping rolls. That is to say, it is widely known that normal rolling of a material having a width larger than the width of the shaping roll is not generally possible since the material is either locally rolled by the side faces of the shaping rolls or a local metal flow is caused in the surface of the material being rolled by the side surfaces.

This limitation on the width of the material being rolled is evident from FIG. 1(*a*) and (*b*) wherein it will be noted that the width of shaping rolls does not change substantially from passes K-11 to K-7.

Figure 2:
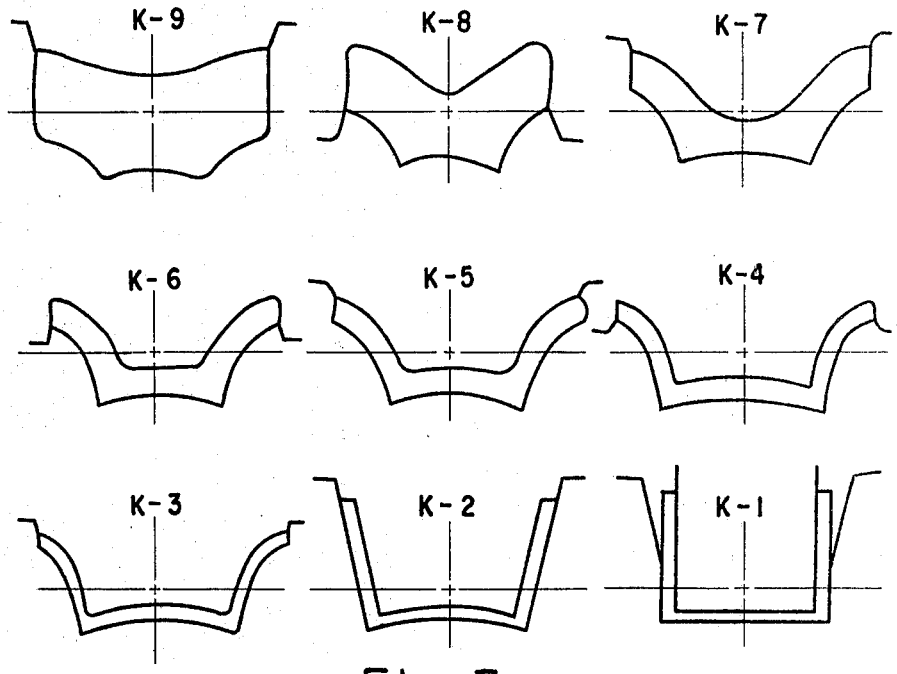
Fig. 2 (PRIOR ART)
FIG. 2 shows one example of a series of conventional shaping roll passes for rolling channel steel sections.

Nevertheless, as seen in FIG. 2, which shows one example of a series of shaping roll passes for rolling channel-shaped steel sections, it is possible to roll materials having a larger width than the width of the shaping rolls in the finishing passes (K-3 to K-1), since the flange portion of the material at this stage has already been subjected to bending deformation before the material enters the bite of the rolls in the rolling stand. Thus at the time the material is actually rolled, its width is substantially the same as the width of the shaping rolls.

Figure 3:
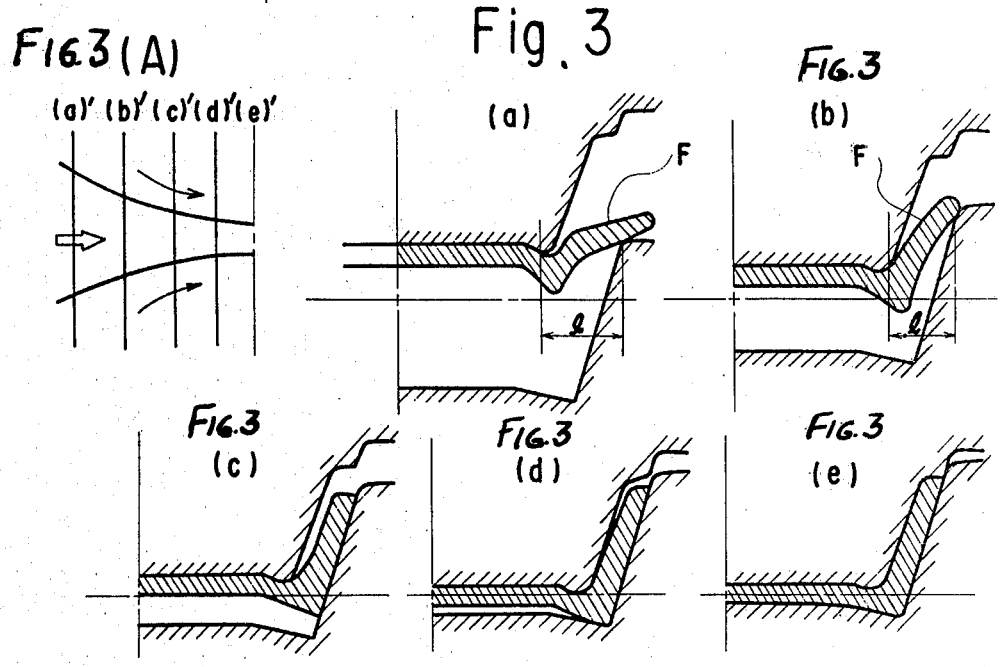
FIGS. 3(*a*)–3(*e*) show progressive stages of contact of the material being rolled with the rolls and the deformation of the material as it advances from the inlet portion of a shaping roll pass to a position direction below the roll, as viewed in vertical corss-sections taken at the points (a)′, (b)′, (c)′, (d)′ and (e)′ in FIG. 3A.

This phenomenon can be easily understood by considering a number of cross sections of the shaping rolls taken vertically in the advancing direction of the material at points between the inlet and outlet sides of the shaping rolls. FIGS. 3(*a*)–(*e*) are vertical cross sections taken at points (a)', (b)', (c)', (d)' and (e)' in FIG. 3A between the inlet of a finishing shaping roll pass for rolling a channel-shaped section and a point directly below the roll and also shows the relation between the shaping rolls and the material at these points. As can be noted from FIGS. 3(*a*)–(*e*), when the angle of inclination of the side wall of the shaping rolls is large, the length l of the arm through which the bending moment is applied to the flange portion of the material by the shaping rolls increases in the direction from the point (e)' directly below the roll toward the inlet portion (a)'. Moreover, because the material being rolled is thin, the flange portion F can be easily bent. Thus, even a material having a width larger than the width of the shaping rolls can be satisfactorily rolled.

Furthermore, as the material passes between the rolls of the rolling stand in the normal rolling operation, the portions thereof which are approaching but have not yet entered the maximum force of the shaping rolls are subjected to a force acting to reduce the width of the material so that a considerable reduction in width is effected at thin portions and portions of low cross sectional rigidity. The deformations occurring during such a roll pass can be regarded as one kind of roll forming.

On the other hand, in the initial stages of rolling a steel sheet pile having a shape corresponding to the shaping roll pass K-1 shown in FIG. 1, the angle of inclination of the side wall is small and the material is thick and has a high cross sectional rigidity. As a consequence, it is difficult to effect bending deformation and, for this reason, the width of the material to be rolled must be slightly smaller than the width of the shaping rolls.

The universal rolling method will now be described in comparison with the shaping rolling method.

FIG. 4 is a plan view schematically showing the roll arrangement of a universal rolling stand for use in the universal rolling method. Because the axes of rotation of the pair of vertical rolls 4 and 4' perpendicular to the axis of the horizontal roll 3, the distance L' between the rolls 4 and 4' at a point spaced toward the inlet side from the maximum space between these rolls is larger than the distance L between the vertical rolls 4 and 4' at the bite, i.e. along a line passing along the bottom of the horizontal roll 3 and the shortest distance between the rolls 4 and 4'. This means that even a material having a width considerably larger than the width of the horizontal roll can easily be introduced between the rolls of the universal rolling stand and rolled.

This geometrical relationship between the rolls in a universal stand is, of course, impossible to achieve in a two-roll rolling stand.

FIGS. 5(*z*) and 5(*b*) schematically respectively show the angle of inclination $\theta$ of the flange portion F in the shaping rolling method and the universal rolling method. Because it is generally advantageous to effect bending deformation within a range wherein the direction of the rolling reduction coincides with the direction of the bending, the universal rolling method shown in FIG. 5(*b*) is more advantageous than the shaping rolling method shown in FIG. 5(*a*) in the rolling of steel sections having a relatively large flange angle $\theta$, such as steel sheet piles.

The present invention has been made taking into consideration the advantages of the universal rolling method.

The present invention is based on the technical idea of making the width of the material entering the universal rolling stand considerably larger than the distance between the opposing outer circumferential surfaces of the vertical rolls in the universal rolling stand and subjecting flanges or flange-like portions of the material to deformation by the bending action of the pair of vertical rolls in cooperation with the horizontal rolls.

According to the present invention, the shaping rolling step prior to the universal rolling steps can be greatly simplified.

The present invention will now be described in more detail.

In FIGS. 6(*a*) and (*b*), two sections 8 and 8' obtained by somewhat different rolling processes are schematically compared. These sections are obtained by rolling blooms 5 and 5' of rectangular cross section by using shaping rolls of different flatness formed respectively by a pair of horizontal rolls 6 and 7 and another pair of horizontal rolls 6', 7', with the same web width W, web thickness tW and flange thickness tF, but with different heights h and h' of the upper rolls 6 and 6' and different angles of inclination $\theta$ and $\theta'$ of the portions f and f' corresponding to the flanges. Differences in the characteristics of the rolled material deformed by shaping rolls of different flatness have been described in many technical reports and, in short, it can be said that the elongation ratio (ratio of the height H of rectangular cross section of the bloom to the web thickness tW) of the web portion of the section being rolled is larger as the height of the shaping portion of the shaping roll and the angle of inclination $\theta$ of the portion of the rolled shaped corresponding to the flange because larger. Thus, in the section 8 shown in FIG. 6(*a*), since both h and $\theta$ are larger than h' and $\theta'$ in FIG. 6(*b*), the metal of the flange portion of the material being rolled tends to be drawn into the web portion, thus reducing the amount of material in the flange portion. As a result, the section 8 has the contour shown by the hatched portion in FIG. 6(*a*). This means that, if the rolled shaped formed by the pair of rolls is made flatter as in the case of rolls 6' and 7' in FIG. 6(*b*), it becomes easier to produce steel sections of the desired contour and dimensions as shown by 8'. Thus, by flattening the shape formed by the shaping rolls, it becomes possible to reduce the required shapes to reach the finished shape and also to use a starting material of flatter and smaller rectangular cross section.

One example of the present invention will be described in comparison with the conventional universal method shown in FIG. 1(*b*).

FIG. 7(A) is a flow sheet showing an example of the present invention applied to the rolling of steel sheet piles having a contour corresponding to the shaping rolls of pass K-1. FIG. 7 (B) is an enlarged view of the profiles of the shaping rolls 11, 12, 14 and 15 of the shaping roll passes K-7 and K-6 in the shaping rolling step and the universal rolls of pass U-5 in the subsequent universal rolling step in the flow sheet of FIG. 7(A).

The present example illustrates the present invention as applied to the rolling of a steel sheet pile having a contour corresponding to the shaping rolls of pass K-1 in FIG. 1(*b*) and is described in respect of the shape in the universal pass and the shaping rolls in the preceding passes for shaping rolling.

The starting bloom used in the conventional universal method is 180 mm high and 480 mm wide in cross section. In the present invention, a bloom having a cross section 110 mm in height and 510 mm in width is used. The following rolling pass schedules are used.

| Conventional Method | | Present Invention | |
|---|---|---|---|
| Shaping Roll Pass | Number of Passes | Shaping Roll Pass | Number of Passes |
| K-12 | 2 | | |
| K-11 | 2 | | |
| K-10 | 2 | | |
| K-9 | 1 | | |
| K-8 | 1 | | |
| K-7 | 1 | K-7 | 3 |
| K-6 | 1 | K-6 | 2 |

The average elongations prior to the universal pass are as follows:

| | Cross Sectional Area of Starting Material $mm^2$ | Cross Sectional Area before Universal Pass $mm^2$ | Number of Passes | Average Elongation |
|---|---|---|---|---|
| Conventional Method | 86,400 | 17,454 | 10 | 1.17 |
| Present Invention | 56,100 | 17,454 | 5 | 1.27 |

The state of contact of the material being rolled with the pair of horizontal rolls and the pair of vertical rolls and the stages of deformation of the material in the universal pass between the inlet side and a position directly below the horizontal roll will now be described with reference to FIGS. 8(*a*)–8(*d*) in connection with the rolling of a steel sheet pile.

FIGS. 8(*a*) (*d*) show slightly cut away vertical cross sections taken at the points (a)', (b)', (c)' and (d)' shown in FIG. 8(A) on the inlet side of the universal pass U-5 shown in FIGS. 7(A) and (B). (The numeral 17 represents the upper horizontal roll of the universal rolling stand and the numeral 18 represents the lower horizontal roll.) The deformation of the material into the rolled section 16 as well as the contact of the material 13 with the upper and lower horizontal rolls 17 and 18, and the vertical rolls 19 and 19' can be understood from these figures. Thus, in FIG. 8(*a*) the material 13 begins to contact the upper and lower horizontal rolls and the vertical rolls 19 and 19'. In FIG. 8(*b*), the bending deformation of the material 13 proceeds and the portions corresponding to the flanges of the material are particularly subjected to the bending force exerted by the vertical rolls 19 and 19' in cooperation with the upper and lower horizontal rolls 17 and 18. In FIG. 8(*c*), the bending of the material 13 is completed and the material closely fits the shape defined by the rolls. In FIG. 8(*d*), the material has been rolled into the final rolled section 16 of a predetermined thickness corresponding to that of the final pass in the universal pass.

According to the present invention, the starting material 9 of rectangular cross section and the shapes of the two roll-shaping roll passes K-7 and K-6 formed by the rolls preceding the universal roll-pass U-5 can be made substantially flatter than those used in the conventional shaping rolling method. Moreover, only two shaping roll passes are required for the shaping rolling steps prior to the universal rolling step in the present invention. This is four shaping roll passes fewer than the six required for shaping rolling prior to the universal rolling step in the conventional method.

The advantages of the present invention will be described using numerical data.

In the universal rolling method as shown in FIG. 1(*b*), the widths of the central portions of the materials in the shaping roll pass K-6 and the universal pass U-5 are compared. The reduction by the vertical rolls in the first pass at U-5 is 36 mm and the width of the shaping rolls to pass K-6, namely the width of the material, increases proportionally. On the other hand, in the example of the present invention as shown in FIGS. 7(A) and (B), it is possible to increase the width of the shaping rolls in pass K-6 by 120 mm as compared the width of the shaping rolls in pass K-6 shown in FIG. 1(*b*). Further, the cross sectional area of the starting material in FIG. 1(*b*) is 86,400 $mm^2$ while the cross sectional area of the material 9 in the example shown in FIGS. 7(A)

and (B) is 56,100 $mm^2$, which is about the same as the cross sectional area of 54,150 $mm^2$ of the starting beam blank used in the caliber rolling method shown in FIG. 1(*a*). Therefore, according to the present invention, the elongation of the material due to rolling is not excessive, and nearly the same product as obtained in the conventional shaping rolling method can be obtained without creating problems such as the lowering of the efficiency of the heating furnace and lowering of the production yield.

The only problem that can be envisioned here is the possibility that, since the vertical rolls 19 and 19' of the universal rolling stand are not driven, the material 13 might not be normally bitten when it first contacts the vertical rolls 19 and 19'. However, in the actual rolling operation, as shown by the hatched portion in FIG. 9, the material being rolled has a tongue-like portion 20 formed during the shaping rolling prior to the universal pass and this portion contacts the horizontal rolls 17 and 18 before it contacts the vertical rolls 19 and 19' so that there is no problem in the gripping of the material, a fact confirmed by actual rolling operations. Even if the tongue-like portion is not formed, the material 13 is bitten by the horizontal rolls 17 and 18 before it is bitten by the vertical rolls 19 and 19', if, for example, the material 13 is maintained as flat as possible in the shaping roll pass (K-6) prior to the universal roll-pass (U-5) and is supplied to the horizontal rolls 17 and 18 having a wavy web groove as shown by U-5 in FIG. 7(A).

On the other hand, when the material 13 is maintained in its wavy form in the shaping roll pass K-6 shown in FIG. 7(A) and the wave height in the pass shape formed by the pair of horizontal rolls 17 and 18 in the universal pass shown in FIG. 7(A) is made higher than that in shaping roll pass K-6, the horizontal rolls bite the material 13 earlier than the vertical rolls 19 and 19'. Normally, the tongue-like portion 20 is almost always formed on the material 21 as shown in FIG. 9 so that satisfactory biting is assured thereby.

With the above rolling procedures, the following advantages are obtained in addition to the advantages of the conventional universal rolling method described earlier.

(1) By adoption of the conventional universal rolling method for steel sheet piles in the manner according to the present invention, the shapes of the shaping rolls used in the rough shaping step can be markedly simplified, and thus the number of shaping roll passes required is considerably reduced.

(2) Reduction of the required number of shaping roll passes makes it possible to lay out new mills more compactly and in existing mills to reduce the number of rolls kept in stock.

(3) The use of flat starting materials of rectangular cross section permits use of a shallower rolled shape than in conventional shaping rolling or universal rolling so that the difference in the circumferential speed of the roll at various portions of the rolled shape profile is reduced with a corresponding reduction in roll wear and lowering of unit roll cost.

(4) Mill layout can be made compact because a bloom of rectangular cross section as small as the beam blank used in the conventional shaping rolling method can be used.

(5) Because of the shallow rolled shape mentioned in (3) above, the rolling condition is similar to that of steel plate so that it is possible to increase the reduction rate per pass over that in the conventional method and to reduce the number of passes, thus improving rolling efficiency.

The foregoing descriptions of embodiments of the present invention have been made in connection with the rolling of steel sheet piles but steel sections include various forms and sizes of rolled materials and the present invention should not be limited to the specific sections described above. The present invention can be applied to rolling of all forms of sections and such rolling is within the scope of the present invention insofar as a material having a large width is used as the starting material and bending deformation of the flange portion of the material being rolled is effected by vertical rolls.

As described hereinbefore, in the present invention the width of the material to be rolled in the universal rolling step is made larger than the width of the pass formed by the pair of horizontal rolls of the universal rolling stand and the flanges or flange-like portions of the material being rolled are subjected to bending deformation by the vertical rolls of the universal stand, whereby it is possible to use a flat bloom of rectangular cross section in place of a roughly shaped beam blank and thus it is possible to employ flat roughing passes in the rough rolling step as compared with the conventional roughing passes; so that the breakdown step and the rough shaping by shaping rolling prior to universal rolling are markedly simplified, namely the number of shaping rolls required and the number of rolls required to be kept in stock are reduced. The unit roll cost is lowered because of less wear on the rolls, the heating furnace efficiency is increased and the mill layout is made compact. In this way, the present invention provides various advantages for rolling of steel sections.

What is claimed is:

1. A method for rolling a steel section having flanges or flange-like portions from a steel bloom of rectangular cross section in a rolling mill comprising a series of roughing shaping rolling stands for roughing the bloom, a universal rolling mill stand having a pair of opposed horizontal rolls and a pair of opposed vertical rolls, and a series of finishing shaping rolling stands for finishing the shape rolled in the universal rolling mill, which method comprises: rolling the bloom in the roughing shaping rolling stands for roughing the bloom to a rough shape having a width greater than the shortest distance between the outer circumferences of the opposed vertical rolls in the universal rolling mill stand and having a reduced cross-section which is relatively flat as compared with the finished steel section, said rough shape portions to be shaped into flanges or flange-like portions in the finished steel section; rolling the thus obtained rough shape in the universal rolling mill stand for causing the pair of vertical rolls and the pair of horizontal rolls to carry out bending deformation mainly of the portions to be shaped into the flanges or flange-like portions; and finish rolling the thus deformed shape in the finishing shaping rolling stands for finishing the shape into the finished steel sections.

2. A method according to claim 4 in which the steel section which is rolled is a steel sheet pile.

3. A method according to claim 4, in which each rolling step includes passing the steel shape through the roughing shaping rolling stands and the universal rolling mill stand at least once in opposite directions.

4. A method according to claim 1, in which the steel section which is rolled in a section which is non-symmetric with respect to an axis extending in the direction of the larger dimension of the section.

5. A method according to claim 4 in which the steel bloom is thinner and wider than a steel bloom used as the starting shape in a conventional method for rolling the same steel section and which uses a series of shaping roll passes prior to a universal rolling mill pass, and said step of rolling the bloom in the roughing shaping rolling stand consists of rolling the bloom in only two roughing shaping roll stands.

* * * * *